US005345783A

United States Patent [19]

Nishikawa

[11] Patent Number: 5,345,783

[45] Date of Patent: Sep. 13, 1994

[54] VIBRATING DEVICE FOR ICE MAKING TRAY

[75] Inventor: Kazunori Nishikawa, Nagano, Japan

[73] Assignee: Kabushiki Kaisha Sankyo Seiki Seisakusho, Nagano, Japan

[21] Appl. No.: 115,117

[22] Filed: Sep. 2, 1993

[30] Foreign Application Priority Data

Sep. 4, 1992 [JP] Japan ..... 4-260596

[51] Int. Cl.[5] ..... F25C 1/12

[52] U.S. Cl. ..... 62/345; 62/353

[58] Field of Search ..... 62/345, 353, 68

[56] References Cited

U.S. PATENT DOCUMENTS

| | | | |
|---|---|---|---|
| 3,451,227 | 6/1969 | Jacobs et al. | 62/68 X |
| 4,852,359 | 8/1989 | Mazzotti | 62/353 X |
| 5,172,556 | 12/1992 | Oike | 62/353 X |
| 5,177,980 | 1/1993 | Kawamoto et al. | 62/353 |
| 5,253,487 | 10/1993 | Oike | 62/353 |

FOREIGN PATENT DOCUMENTS 315668 7/1991 Japan .

*Primary Examiner*—William E. Tapolcai

*Attorney, Agent, or Firm*—Sughrue, Mion, Zinn, Macpeak & Seas

[57] ABSTRACT

A vibrating device for an electric refrigerator contains an ice making tray for making an ice from a water which is supplied to the ice making tray; a fulcrum member mounted on the ice making tray rotatable about the fulcrum member; an ice storing chamber for storing the ice which has been made in the ice making tray by rotating the ice making tray about the fulcrum member; rotation device for rotating the fulcrum member to perform an ice removing operation applied to the ice making tray; reciprocation device for supporting the fulcrum member in a horizontal direction which is orthogonal to an axis direction of the fulcrum member and for reciprocating the fulcrum member in the horizontal direction which is orthogonal to the axis direction of the fulcrum member.

9 Claims, 7 Drawing Sheets

VIBRATING DEVICE FOR ICE MAKING TRAY

BACKGROUND OF THE INVENTION

Field of the Invention

The present invention relates generally to an automatic ice making apparatus such as an electric refrigerator or the like. More particularly, the present invention relates to a vibrating device for an ice making tray arranged in the automatic ice making apparatus.

Prior Art

According to a conventional art as disclosed in Unexamined Japanese Utility Model Publication Hei. 3-158668, to make a transparent ice by deaerating water in an ice making tray, the latter is arranged so as to move in the direction of a center axis of the shaft for turning the ice making tray, and a series of vibrations each effective in the direction of the center axis of the shaft for the ice making tray are generated with the aid of a solenoid for unidirectionally driving the ice making tray and a spring for restoring the solenoid to the original state after each vibration is generated. With the electromagnetic type vibrating means of the foregoing type, however, there arises a malfunction that noisy sound is usually induced as the vibrations are sequentially generated. For this reason, the conventional art is unsuitably employable for an electric refrigerator for home use, provided that the conventional electromagnetic type vibrating means is incorporated in the electric refrigerator.

SUMMARY OF THE INVENTION

The present invention has been made in consideration of the aforementioned background and its object resides in providing a vibrating device for an ice making tray in place of the conventional vibration generating means proposed according to the conventional art wherein each reciprocable vibrative movement is forcibly induced without generation of noisy sound by driving the vibrating device.

To accomplish the above object, according to one aspect of the present invention, there is provided a vibrating device for an electric refrigerator comprising: an ice making tray for making an ice from a water which is supplied to the ice making tray; a fulcrum member mounted on the ice making tray rotatable about the fulcrum member; an ice storing chamber for storing the ice which has been made in the ice making tray by rotating the ice making tray about the fulcrum member; rotation means for rotating the fulcrum member to perform an ice removing operation applied to the ice making tray; reciprocation means for supporting the fulcrum member in a horizontal direction which is orthogonal to an axis direction of the fulcrum member and for reciprocating the fulcrum member in the horizontal direction which is orthogonal to the axis direction of the fulcrum member.

DETAILED DESCRIPTION OF THE PREFERRED EMBODIMENTS

The present invention will now be described in detail hereinafter with reference to the accompanying drawings which illustrate a preferred embodiment thereof.

Figure 1:
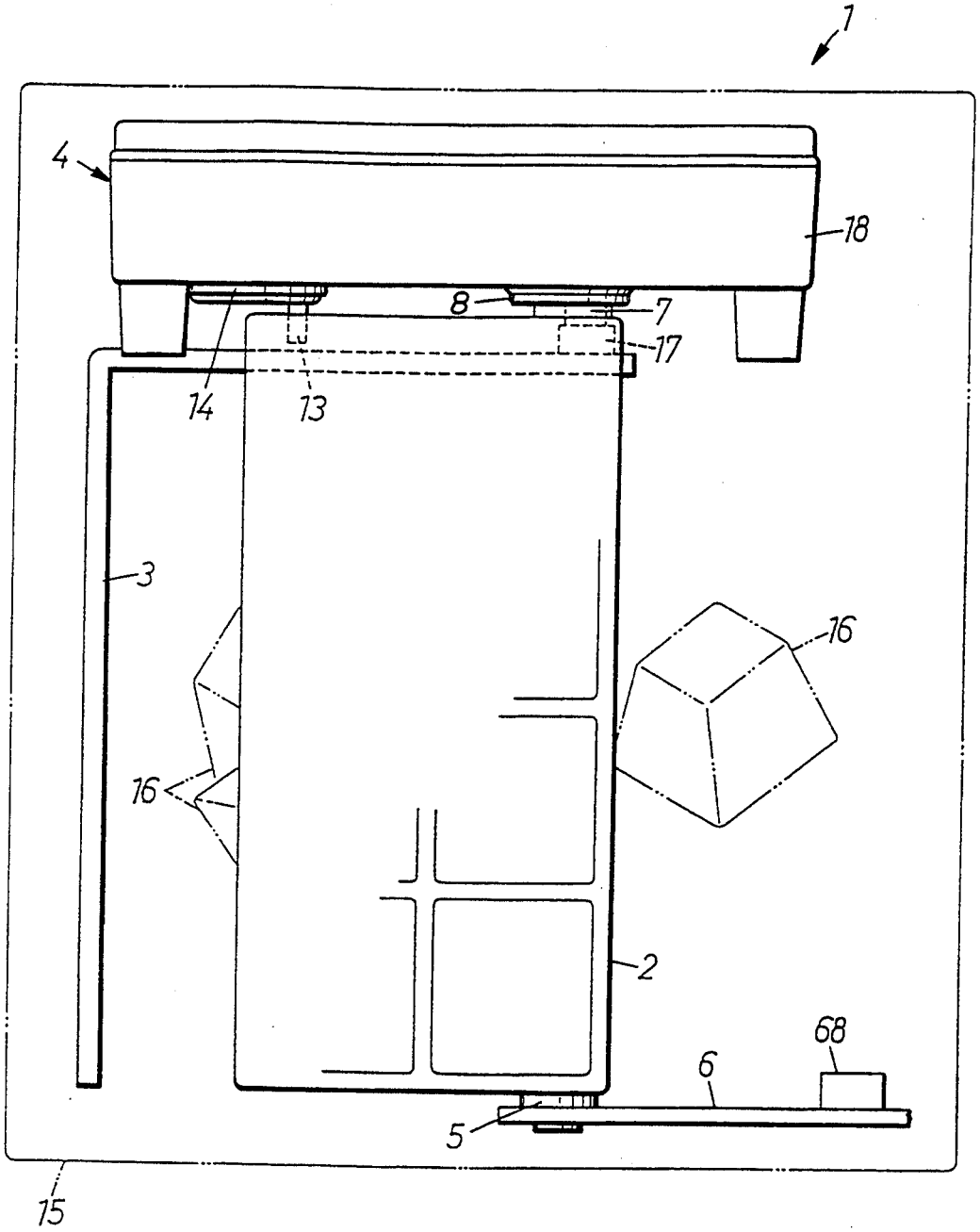
FIG. 1 is a plan view of an automatic ice making apparatus of the present invention, particularly showing the whole structure of the same.
Figure 2:
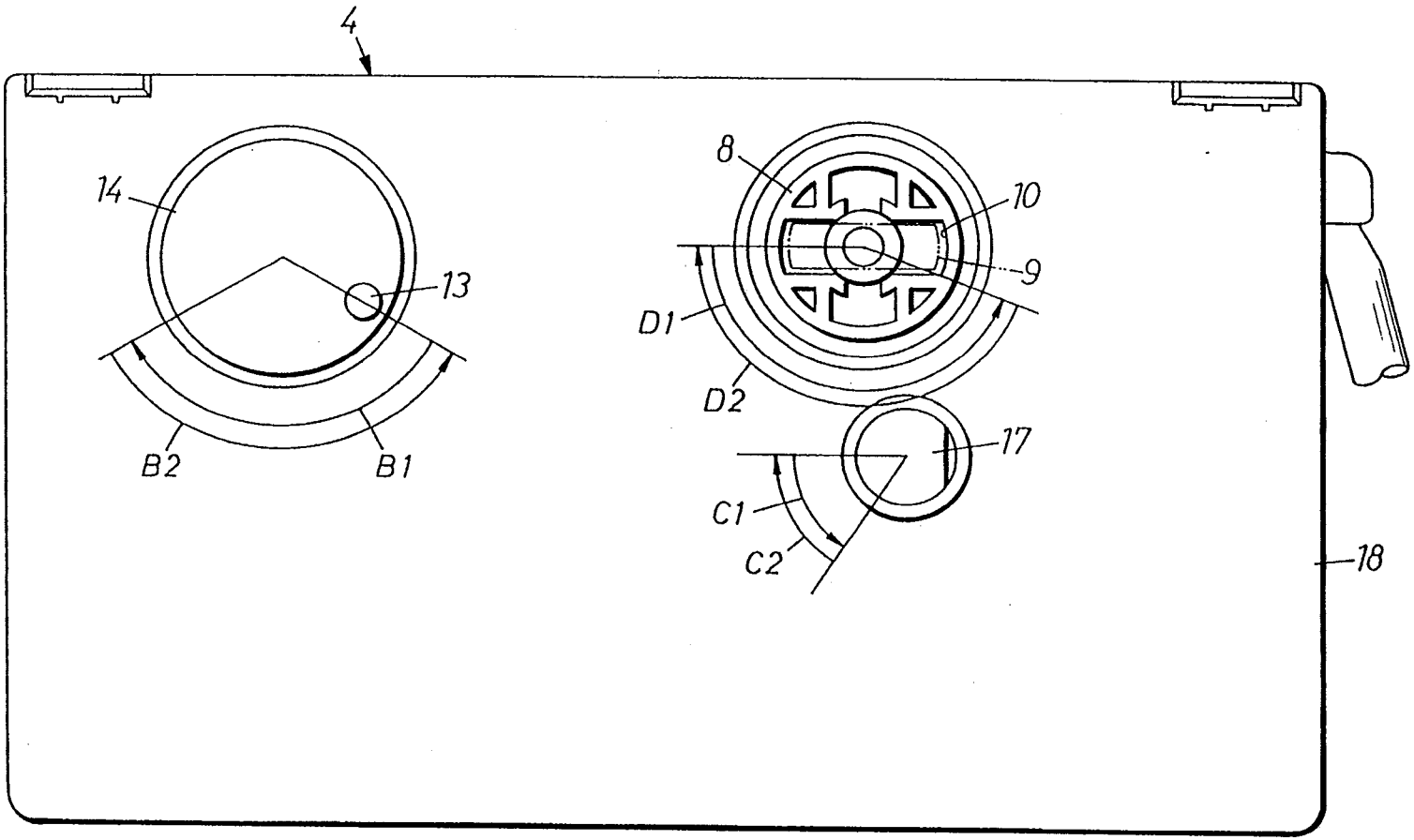
FIG. 2 is an enlarged front view of a driving unit for the automatic ice making device of the present invention.

FIG. 1 shows by way of plan view the structure of an automatic ice making apparatus 1 to which the present invention is applied, and FIG. 2 is a fragmentary front view of the automatic ice making apparatus, particularly showing the structure of a driving unit on an enlarged scale. The automatic ice making apparatus 1 is composed of a rectangular ice making tray 2, an ice detecting lever 3 and a driving unit 4 for vibratively driving the ice making tray 2. As is apparent from FIG. 1, the ice making tray 2 is designed in a rectangular contour, and it is supported in such a manner that the right-hand corner on the horizontal driven side is turnably connected to a frame 6 of the automatic ice making apparatus 1 to turn about a fulcrum shaft 5, while the right-hand side on the driving side is operatively connected to an output shaft 8 of the driving unit 4 via a fulcrum shaft 7.

Figure 5:
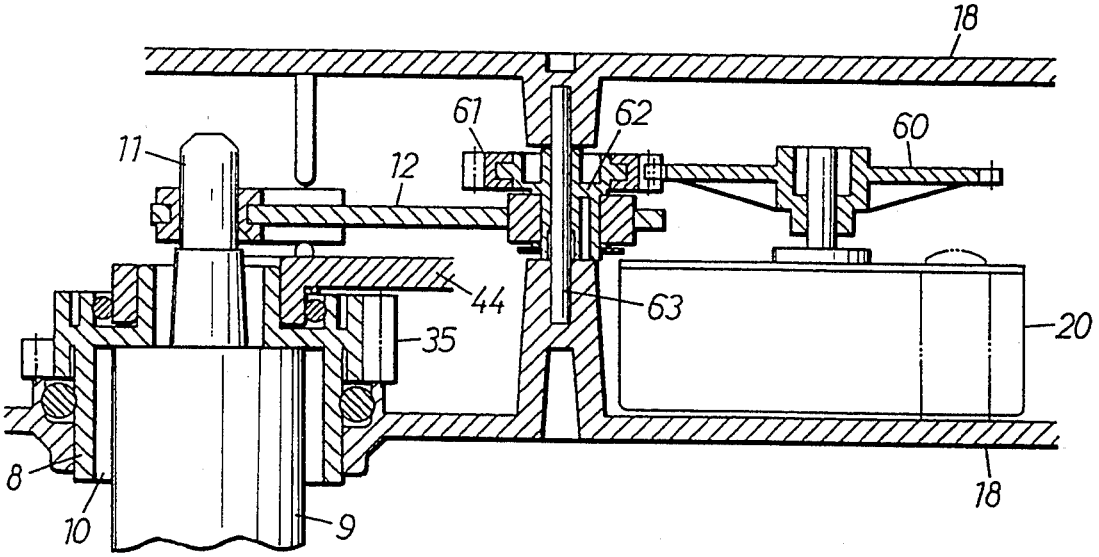
FIG. 5 is a fragmentary enlarged horizontal sectional view of the driving unit of the present invention, particularly showing the arrangement of a vibrating device, an output shaft and associated components in the driving unit.

As shown in FIG. 1, FIG. 2 and FIG. 5, the fulcrum shaft 7 is inserted into an elongated hole 10 of the output shaft 8 having a flat shaft 9 formed therein such that it can be displaced in the horizontal direction oriented at a right angle relative to the center axis of the fulcrum shaft 7. As is best seen in FIG. 5, a joint shaft 11 at the foremost end of the flat shaft 9 is operatively connected to a joint link 12 disposed in the driving unit 4. It should be noted that the output shaft 8 is rotatably supported by a case 18 of the driving unit 4 and an intermediate plate 44 of the same. The joint link 12 is disposed in the driving unit 4 for the purpose of imparting vibrations to the fulcrum shaft 7. Since the disposing of the joint link 12 in that way forms a characterizing feature of the present invention, detailed description of the joint link 12 will be made later.

Figure 6:
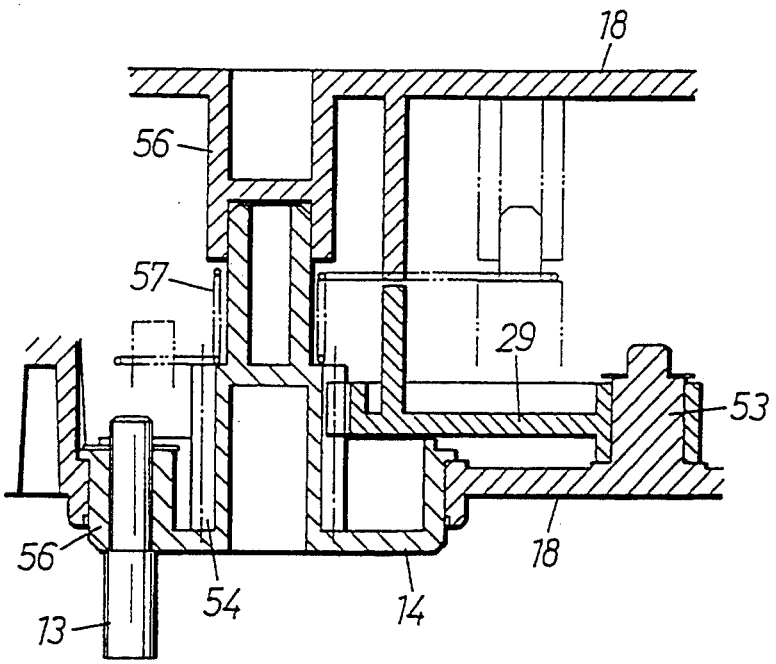
FIG. 6 is a fragmentary enlarged horizontal sectional view of the driving unit of the present invention, particularly showing the arrangement of a rotary member operable for the purpose of escaping and associated components in the driving unit.

The ice making tray 2 is turnably supported by a pair of horizontal fulcrum shafts 5 and 7 on the right-hand corner side. In addition, the ice making tray 2 is supported from below by a holding portion 13 of the driving unit 4 on the left-hand bottom corner side. As is best seen in FIG. 6, the holding portion 13 is assembled with the driving unit 4 via a rotary member 14 adapted to be rotated for the purpose of escaping so that it is rotationally driven by a common driving section for the fulcrum shaft 7 and the output shaft 8.

In this embodiment, as shown in FIG. 2, the angle of rotation of the rotary member 14 serving as an escaping portion is set to 120 degrees. During ice making, the output shaft 8 serves to allow the ice making tray 2 to be oriented in the upward direction, and subsequently, at the time of removing a plurality of ice blocks from the ice making tray 2 after water is frozen, it is rotated by an angle of about 160 degrees so that it is oriented in the downward direction.

Figure 7:
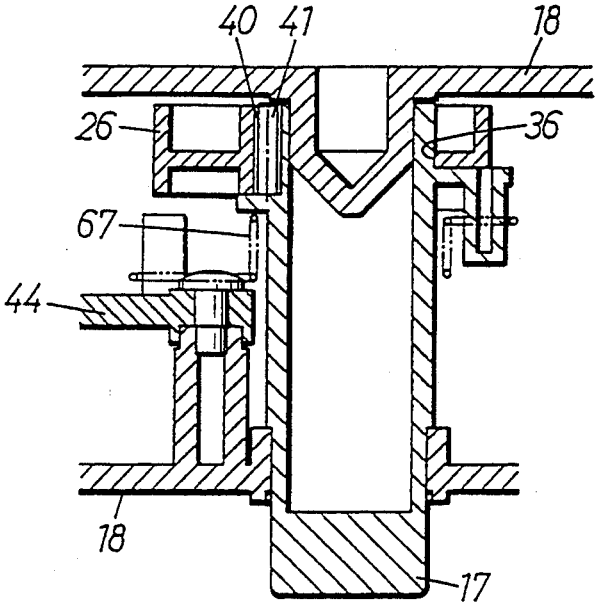
FIG. 7 is a fragmentary enlarged horizontal sectional view of the driving unit of the present invention, particularly showing the arrangement of an ice detecting shaft and associated components in the driving unit.

As shown in FIG. 1, FIG. 2 and FIG. 7, the ice detecting lever 3 is turnably supported in an ice storing chamber 15 to turn about an ice detecting shaft 17 of the driving unit 4 by an angle of about 55 degrees in order to detect how many ice blocks 16 are stored in the ice block storing chamber 15.

FIG. 3 to FIG. 7 show the structure of the driving unit 4 in detail. To assure that each of the output shaft 8, the rotary member 14 serving as an escaping portion and the ice detecting lever 3 is turned by a predetermined angle, the driving unit 4 includes a DC motor 19 in a split type case 18. In addition, to assure that the ice making tray 2 is vibrated in the horizontal direction to reciprocably move by a small distance in order to deaerate water during the ice making operation, the driving unit 4 includes a stepping type motor 20.

Rotation of the DC motor 19 is transmitted to a cam-shaped gear 24 via a worm 21, a speed reduction gear (worm wheel) 22 and a gear 23 in the arrow A1-marked direction or in the arrow A2-marked direction depending on a mode of operation of the automatic ice making apparatus 1. To restrictively determine the order of a series of operations to be performed in operative association with the ice making the cam-shaped gear 24 is turnably supported to turn about a stationary shaft 25 disposed in the case 18.

Figure 4:
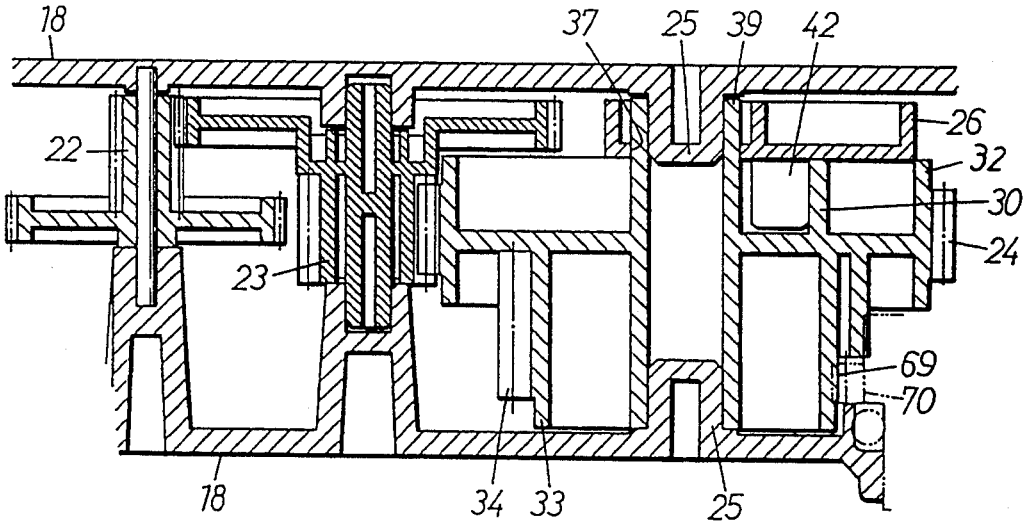
FIG. 4 is a fragmentary enlarged horizontal sectional view of the driving unit of the present invention, particularly showing the arrangement of a cam-shaped gear and associated components in the driving unit.
Figure 10:
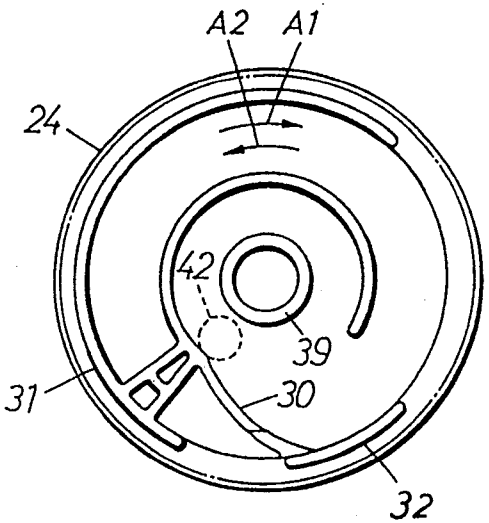
FIG. 10 is a fragmentary enlarged rear view of the cam-shaped gear arranged in the driving unit.
Figure 9:
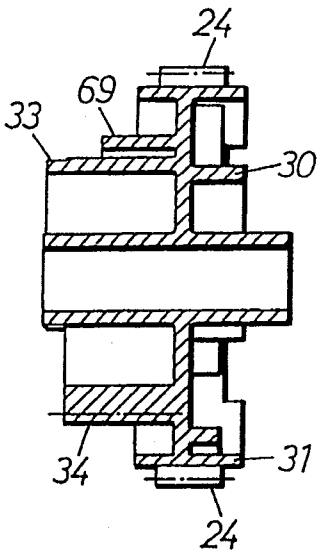
FIG. 9 is a sectional view of the cam-shaped gear taken along a cut line as represented by arrow marks in FIG. 8.
Figure 8:
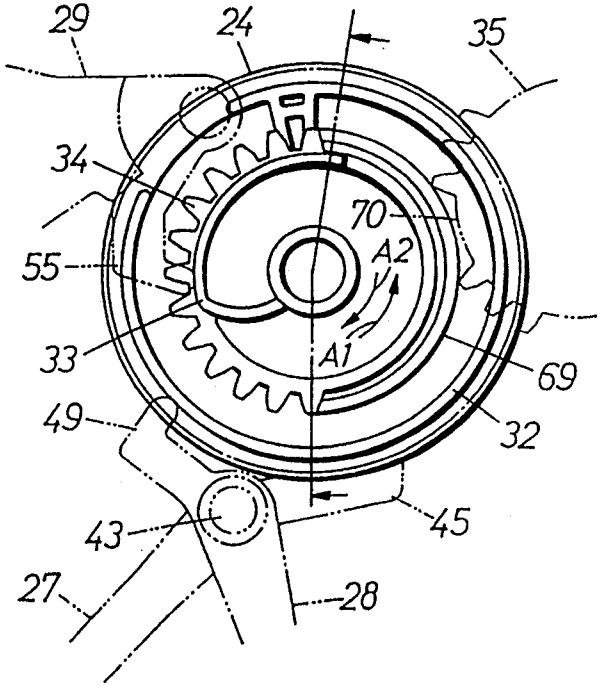
FIG. 8 is an enlarged front view of a cam-shaped gear and associated components arranged in the driving unit of the present invention.

Referring to FIG. 8, FIG. 9 and FIG. 10 in addition to FIG. 4, the cam-shaped gear 24 includes a C-shaped cam 30 for slidably driving a slider 26 and a discontinuously extending arc-shaped cam 31 for turnably driving an operation position lever 27 on one side thereof, i.e., on the right-hand side as seen in FIG. 9. In addition, the cam-shaped gear 24 includes an arc-shaped cam 32 for turnably driving an original position lever 28, a cam 33 for rotationally driving a sector gear 29, and a partial gear 34 and a circumferential portion 69 for rotationally driving an output shaft 35 integrated with the output shaft 8 or stopping the rotation of the same, and these components are located on the other side of the cam-shaped gear 24. When the circumferential portion 69 abuts against a non-gear portion 70 of the output gear 35, it serves as a stopper for preventing the output gear 35 from being rotated further.

The slider 26 includes two elongated holes 36 and 37 in which a boss 38 of the ice detecting shaft 17 and a boss 39 of the cam gear 24 are fitted so as to allow both the bosses 38 and 39 to slidably move within the range defined by the elongated holes 36 and 37. With this construction, as a cam follower 42 comes in contact with the inner peripheral surface of the cam 30, both the bosses 38 and 39 are caused to reciprocably linearly move in the elongated holes 36 and 37.

The linear movement of the bosses 38 and 39 is transmitted to a partial pinion gear 41 of the ice detecting shaft 17 via a rack 40 generated on the inner peripheral surface of the elongated hole 36 so as to allow the partial pinion gear 41 to be rotated by an angle of about 55 degrees. The slider 26 includes a limiting piece 65 on the right-hand side corresponding to a protuberance 66 of the operation position lever 27. As the ice detecting shaft 17 is rotated, the limiting piece 65 abuts against the protuberance 66 of the operation position lever 27.

The ice detecting shaft 17 includes a twist spring 67 which serves to normally bias the ice detecting lever 3 so as to allow it to be rotated in the ice detecting direction from the horizontal state by the resilient force of the twist spring 67. Thus, the slider 26 receives the biasing resilient force of the twisting spring 67 via the rack 40 and the pinion gear 41 so that it is biased in such a direction that the cam follower 42 comes in contact with the cam 30.

The operation position lever 27 is turnably supported to turn about a lever shaft 43 integrated with the case 18. A cam follower 45 on the left-hand side of the operation position lever 27 is brought in contact with the cam 31, while a permanent magnet 46 on the right-hand side of the same cooperate with an operation position switch 48 fixedly secured to a circuit board 47. The original position lever 28 is turnably supported to turn about the lever shaft 43 in the same manner as the operation position lever 27. A cam follower 49 on the upper side of the original position lever 28 is brought in contact with the cam 32, while a permanent magnet 50 on the lower side of the same cooperates with an original position switch 51 fixedly secured to the circuit board 47.

Figure 3:
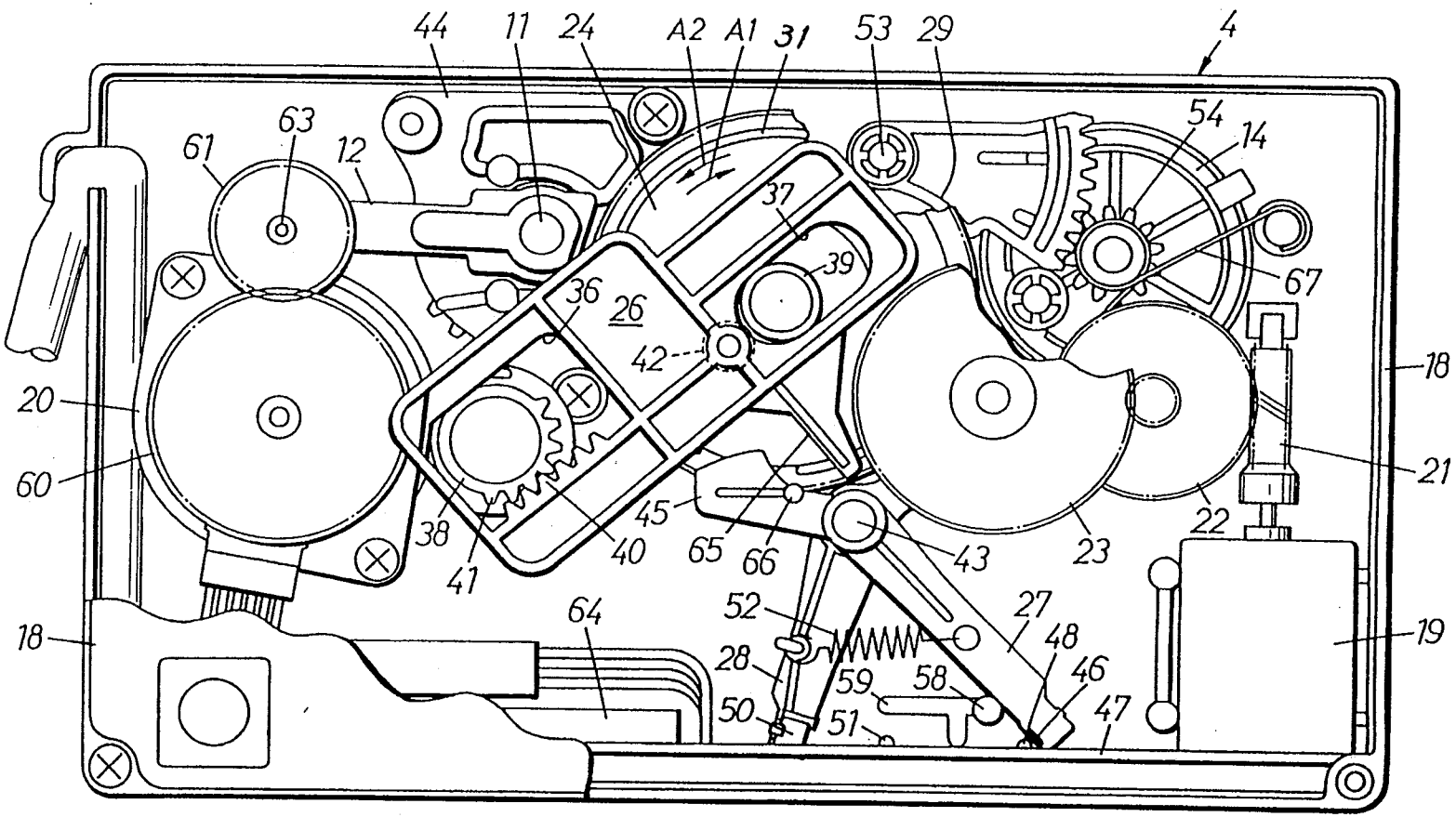
FIG. 3 is an enlarged rear view of the driving unit of the present invention, particularly showing the interior of the same.

As is best seen in FIG. 3, the operation position lever 27 and the original position lever 28 are biased in the opposite direction relative to each other by the resilient force of a tensile spring 52. When both the lever 27 and 28 abut against the corresponding stoppers 58 and 59, the operation position switch 48 and the original position switch 51 are turned on.

The sector gear 29 is turnably supported to turn about a shaft 53 integrated with the case 18 so as to mesh with a gear 54 integrated with the rotary member 14. As shown in FIG. 8, a cam follower 55 of the sector gear 29 on the lower side of the latter is brought in contact with the cam 33. The rotary member 14 is rotatably supported to rotate in a bearing 56 integrated with the case 18. In addition, the rotary member 14 is normally biased in the B1 arrow-marked direction in FIG. 2 by the resilient force of the twisting spring 57.

According to the present invention, the vibrating device serves as means for reciprocably displacing the fulcrum shaft 7 in the horizontal direction in the following manner.

As shown in FIG. 5, rotation of the stepping type motor 20 is transmitted to a gear 61 rotatably supported by a shaft 63 fitted to the case 18 via a gear 60 at an increased rotational speed, and thereafter, rotation of the gear 61 is transmitted to the joint link 12 via an eccentric shaft 62 integrated with the gear 61. As mentioned above with reference to FIG. 1 and FIG. 2, the left-hand side of the joint link 12 is reciprocably connected to the joint shaft 11 of the fulcrum shaft 7.

Controlling of both the motors 19 and 20 and processing of signals outputted from the operation position switch 48 and the original position switch 51 are executed by a control section 64 installed on the circuit board 47 in cooperation with a microcomputer disposed on the refrigerator side.

Figure 11:
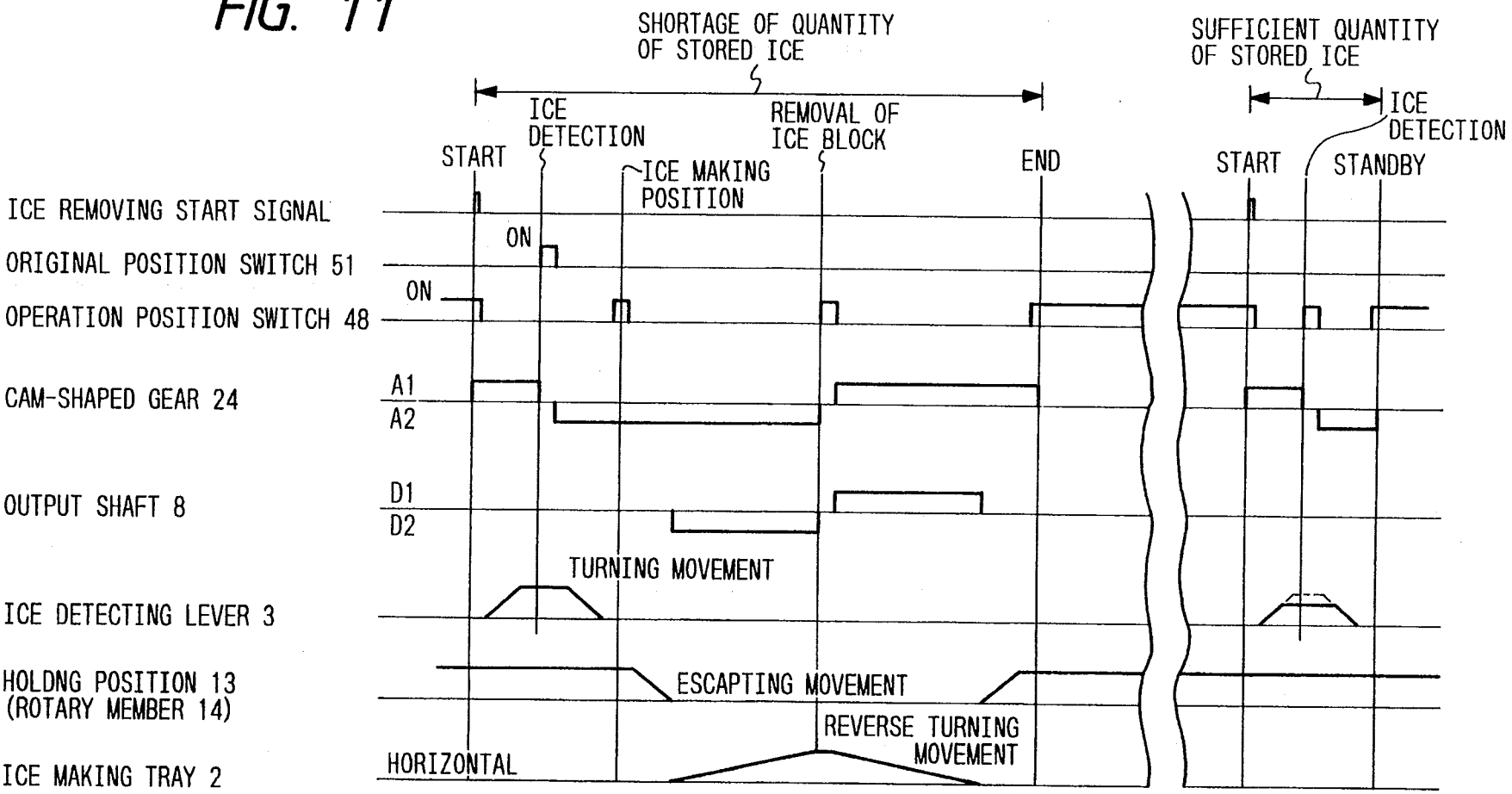
FIG. 11 shows by way of timecharts a mode of operation of the automatic ice making apparatus.

FIG. 11 shows by way of timecharts a mode of operation of the automatic ice making apparatus 1. The left-hand parts of the timecharts show the order of operations to be performed at the time when the automatic ice making apparatus 1 stores a small quantity of ice, i.e., at the time of shortage of a quantity of stored ice blocks 16, while the right-hand parts of the same show the order of operations to be performed at the time when the automatic ice making apparatus 1 stores an ample quantity of ice blocks 16 in the ice block storing chamber 15.

In the standby state or in the operative state of the automatic ice making apparatus 1 on completion of the ice making operation, the ice making tray 2 and the ice detecting lever 3 are laid with a horizontal attitude, and the holding portion 13 is located below the ice making tray 2 while coming in contact with the bottom surface of the same. While the foregoing state is maintained, since the cam follower 45 of the operation position lever 27 comes in contact with the discontinuous part of the cam 31, the right-hand side of the operation position lever 27 is brought in collision against the operation position switch 48, causing the latter to be turned on. In response to a signal outputted from the operation position switch 48, the control section 64 confirms that the automatic ice making apparatus 1 is held in the standby state.

When a signal for instructing that a plurality of ice blocks 16 start to be removed from the ice making tray 2 is inputted into the control section 64 from the microcomputer on the refrigerator side at a predetermined time interval, the control section 64 is activated to start rotation of the DC motor 19 so as to allow the cam-shaped gear 24 to be rotated in the A1 arrow-marked direction (see FIG. 3, FIG. 8 and FIG. 10). As the cam-shaped gear 24 is rotated, the cam follower 45 of the operation position lever 27 abuts against the discontinuous arc-shaped cam 31, causing the permanent magnet 46 to be parted away from the operation position switch 48, whereby the latter is turned off.

As the cam-shaped gear 24 is rotated in the A1 arrow-marked direction in the above-described manner, the cam follower 42 of the slider 26 is parted away from the stationary shaft 42, causing the ice detecting shaft 17 to be turned within the range of an angle of 55 degrees in the C1 arrow-marked direction (see FIG. 2), whereby the ice detecting lever 3 is turned from the horizontal state in the ice detecting direction.

At this time, since the cam follower 49 of the original position lever 28 is brought in contact with the discontinuous part of the arc-shaped cam 32, the permanent magnet 50 of the original position lever 28 approaches toward the original position switch 51, causing the latter to be turned on. In response to a signal outputted from the original position switch 51, the control section 64 is activated so as to allow the DC motor 19 to be rotated in the A1 arrow-marked direction.

When the control section 64 detects that a small quantity of ice blocks 16 is stored in the ice storing chamber 15, the ice detecting lever 3 is turned within the range from 45 degrees to 55 degrees so that the slider 26 is slidably displaced by a distance corresponding to the turning movement of the ice detecting lever 3, whereby the limiting piece 65 of the slider 26 abuts against the protuberance 66 of the operation position lever 27, causing the operation position lever 27 to be turned in the anticlockwise direction. Thus, the permanent magnet 46 disposed at the lower end of the operation position lever 27 is not permitted to come in contact with the operation position switch 48 any more, causing the latter to be continuously turned off.

As the cam-shaped gear 24 is rotated in the A1 arrow-marked direction, the rotational force given by the pinion gear 41 causes the cam follower 42 of the slider 26 to be displaced away from the stationary shaft 25, whereby the ice detecting lever 3 is turned via the ice detecting shaft 17 from the horizontal state in the ice detecting direction, i.e., in the C1 arrow-marked direction (see FIG. 2) within the range of an angle of 55 degrees.

At this time, since the cam follower 49 of the original position lever 28 is brought in collision against the discontinuous part of the arc-shaped cam 32, the permanent magnet 50 disposed at the lower end of the original position lever 28 approaches toward the original position switch 51, causing the latter to be turned on. In response to a signal outputted from the original position switch 51, the control section 64 is activated so as to allow the DC motor 19 to stop its rotation in the A1 arrow-marked direction.

When the control section 64 detects that there arises a shortage of a quantity of ice blocks 16 stored in the ice block storing chamber 15, it causes the ice detecting lever 3 to be rotated within the range from 45 degrees to 55 degrees so that the slider 26 is displaced at a distance corresponding to the foregoing turning movement of the ice detecting lever 3, resulting in the limiting piece 65 of the slider 26 abutting against the protuberance 66 of the operation position lever 27. Thus, the operation position lever 27 is not permitted to approach toward the original position switch 48 any more, causing the latter to be continuously turned on.

At this time, the control section 64 confirms that the operation position switch 48 is turned off. In addition, the control section 64 confirms that there arises a shortage of a quantity of ice blocks 16 stored in the ice block storing chamber 15, and thereafter, it causes the DC motor 19 to be rotated in the reverse direction after the rotation of the DC motor 19 is stopped for a certain period of time, whereby the cam-shaped gear 24 is rotationally driven in the A2 arrow-marked direction.

Since the cam-shaped gear 24 is rotated in the A2 arrow-marked direction as the DC motor 19 is rotated in the reverse direction, the ice detecting lever 3 is turned in the C2 arrow-marked direction until it returns to the original position. At this time, the operation position switch 48 is restored to the same state as that at the starting time of the automatic ice making apparatus 1, i.e., the operative state that the operation position switch 48 is turned on. In the meanwhile, the output shaft 8 and the rotary member 14 are positionally determined to assume the ice making position without any rotation thereof.

Thereafter, since the cam-shaped gear 24 is continuously rotated in the A2 arrow-marked direction, the cam 33 of the cam-shaped gear 24 turns the cam follower 55 in the anticlockwise direction (see FIG. 8), causing the sector gear 29 to be turned together with the rotary member 14 by an angle of about 120 degrees in the B1 arrow-marked direction (see FIG. 2), whereby the holding portion 13 is parted away from the bottom surface of the ice making tray 2 so that it is turnably displaced outside of the range of turning movement of the ice making tray 2. Thus, the ice making tray 2 is ready to turn in the D1 arrow-marked direction.

After the holding portion 13 is turnably displaced away from the ice making tray 2 in that way, the collision of the peripheral portion 69 of the cam gear 24 against the discontinuous gear portion 70 of the output gear 35 as shown in FIG. 8 is canceled, and subsequently, the partial gear 34 meshes with the output gear 35 so as to rotationally drive the output gear 35 which has been held without any rotation thereof, whereby the output shaft 8 is rotated by an angle of about 160 degrees in the D1 arrow-marked direction (see FIG. 2).

Consequently, the rotation of the output shaft 8 is received by the flat shaft 9 of the ice making tray 2 so that the latter is turnably displaced together with the output shaft 8 from the horizontal state to turn about the fulcrum shafts 5 and 7 until the upper opening surface of the ice making tray 2 is oriented in the downward direction. As desired, the ice making tray 2 may be held in the inclined state at the intermediate time when the frame 6 abuts against a stopper 68 so as to twist it in an axis direction thereof before the ice making tray 2 is turned to reach a maximum twist angle of 160 degrees. When the ice making tray 2 is held in the downwardly inclined state, a plurality of ice blocks 16 stored in the ice making tray 2 are removed from the ice making tray 2 so that they fall down in an ice block storing chamber 15.

In such manner, a series of ice making steps are completed. At this time, the control section 64 can confirm the operational state of removal of the ice blocks 16 from the ice making tray 2 by allowing the permanent magnet 46 disposed at the lower end of the operation position lever 27 to approach toward the operation position switch 48 until the latter is turned on.

After completion of the confirming operation, the control section 64 instructs the respective components in the following manner.

First, the DC motor 19 is rotated in the reverse direction so as to rotate the output shaft 8 in the D2 arrow-marked direction so that the ice making tray 2 is restored to the original horizontal state, and thereafter, the rotary member 14 is rotated in the B2 arrow-marked direction to return to the original position where the holding portion 13 is brought in contact with the bottom surface of the ice making tray 2 held in the horizontal state so as to hold the ice making tray 2 from below. After the ice block storing chamber 15 is supplemented with a plurality of ice blocks 16, a series of ice making steps are completed. On completion of the removal of the ice blocks 16 from the ice making tray 2, the automatic ice making apparatus 1 is restored to the starting (original) position where it is ready to start a next series of ice making steps including an ice detecting step and an ice block removing step.

While the foregoing state is maintained, the ice making tray 2 is supplied with water to be frozen, and thereafter, the program goes to an ice making step. During the ice making operation, rotation of the stepping type motor 20 is transmitted to the eccentric shaft 62 via the gears 60 and 61 so that the flat shaft 9 immovably held in the output shaft 8 is reciprocably displaced in the elongated hole 10 by the joint link 12, whereby the ice making tray 2 held with a horizontal attitude is continuously vibrated from the fulcrum shaft 7 side in the horizontal direction.

As the ice making tray 2 is vibrated in that way, the water stored in the ice making tray 2 is upwardly deaerated, and subsequently, it is increasingly frozen from the bottom side of the ice making tray 2. This leads to the result that a plurality of transparent ice blocks 16 can be made in the ice making tray 2. As desired, a heater may be disposed above the ice making tray 2 in order that the upper surface of the water stored in the ice making tray 2 is heated by the heater and it is frozen only from the bottom surface of the ice making tray 2 during the ice making operation so as to prevent air bubbles in the water from being entrapped in each ice block 16. In this case, any ice block removing operation is not permitted during the ice making operation.

When a predetermined quantity of ice blocks 16 are stored in the ice block storing chamber 15 at the intermediate time of an ice detecting operation, the ice detecting lever 3 abuts against the ice blocks 16 so that it is turned by an angle of 45 degrees or less. At this time, the slider 26 is slidably displaced at a small distance corresponding to the turning movement of the ice detecting lever 3. At the time of the slidable displacement of the slider 26, since the limiting piece 65 of the slider 26 does not abut against the protuberance 66 of the operation position lever 27, the operation position lever 27 is turned at the time of the ice detecting operation, whereby the permanent magnet 46 disposed at the lower end of the operation position lever 27 approaches toward the operation position switch 48, causing the latter to be turned on.

In response to a signal outputted from the operation position switch 48 which has been turned on, the control section 64 confirms that a large quantity of ice blocks 16 are stored in the ice storing chamber 15, and thereafter, it causes the cam-shaped gear 24 to be rotated in the A2 arrow-marked direction until the cam-shaped gear 24 is restored to the standby position where the automatic ice making apparatus 1 is ready to start a next ice making operation.

As is apparent from the above description, since the ice detecting operation and the ice block removing operation are performed in the opposite direction relative to each other, and after completion of the ice detecting operation, the cam-shaped gear 24 is restored to the original position regardless of the presence or the absence of a plurality of ice blocks 16, the next ice making operation can be shifted to a next ice detecting/ice block removing operation immediately after the standby state expires.

According to the present invention, since the direction of extension of the output shaft of the stepping type motor, the direction of extension of each fulcrum shaft for the ice making tray and the direction of extension of the eccentric shaft are coincident with each other, the vibrating device becomes simple in structure with the result that the following advantageous effects are obtainable with the vibrating device. Specifically, one of them is such that each mechanical component can be designed with a reduced thickness. Other one is such that since suitable gears can be interposed between the stepping type motor and the reciprocating mechanism, a frequency of the vibrating device can easily be determined. Another advantage is such that the frequency of the stepping motor can variably be determined within a wide range. A further advantage is such that since vibrations effective in the horizontal direction can forcibly be imparted to the ice making tray at any time of the reciprocable movement of the slider with the aid of the eccentric shaft and the link mechanism, the vibrating device can silently be operated at a high efficiency not only without any generation of noisy vibration sound but also without any necessity for a return spring or the like that is the case with the conventional solenoid type vibrating device.

What is claimed is:

1. (Amended) A vibrating device for an electric refrigerator comprising:

an ice making tray for freezing a liquid which is supplied to the ice making tray;

a fulcrum member mounted on the ice making tray, said ice making tray being rotatable about the fulcrum member;

rotation means for rotating the fulcrum member to perform a frozen liquid removing operation applied to the ice making tray;

a storing chamber for storing frozen liquid which has been removed from the ice making tray by the frozen liquid removing operation applied to the ice making tray;, reciprocation means for supporting the fulcrum member in a horizontal direction which is orthogonal to an axis direction of the fulcrum member and for reciprocating the fulcrum member in the horizontal direction which is orthogonal to the axis direction of the fulcrum member wherein the reciprocation means includes:

a flat member driven by a motor; and a link mechanism for coupling the flat member with the fulcrum member.

2. A vibrating device as claimed in claim 1, wherein the motor includes a stepping motor.

3. A vibrating device as claimed in claim 1, wherein at least one gear is arranged between the motor and the fulcrum member.

4. A vibrating device as claimed in claim 3, wherein the at least one gear includes a speed increasing gear train.

5. A vibrating device as claimed in claim 1, wherein the rotation means is driven by a first motor, the reciprocation means is driven by a second motor, an output shaft is driven through the second motor, the output shaft is engagable with the fulcrum member, and when the output shaft is engaged with the fulcrum member, the output shaft is fixed to the fulcrum member in a rotation direction thereof and is free from the fulcrum member in a radial direction thereof so as to allow the fulcrum member to rotate and reciprocate.

6. A vibrating member as claimed in claim 5, wherein an elongate hole is provided with the output shaft and a flat shaft is connected to the fulcrum member.

7. A vibrating device for an electric refrigerator comprising:

an ice making tray for freezing a liquid which is supplied to the ice making tray;

a fulcrum member mounted on the ice making tray, said ice making tray rotatable about the fulcrum member;

rotation means for rotating the fulcrum member to perform a frozen liquid removing operation applied to the ice making tray;

a storing chamber for storing frozen liquid which has been removed from the ice making tray by the frozen liquid removing operation applied to the ice making tray;

reciprocation means for supporting the fulcrum member in a horizontal direction which is orthogonal to an axis direction of the fulcrum member and for reciprocating the fulcrum member in the horizontal direction which is orthogonal to the axis direction of the fulcrum member;

a holding member arranged below a lower portion of a corner edge of the ice making tray, the holding member being displaced away from the lower portion of the corner edge of the ice making tray by the rotation means, wherein the fulcrum member is arranged on an other corner edge of the ice making tray.

8. A vibrating device as claimed in claim 7, wherein the fulcrum member includes a pair of fulcrum shafts, one fulcrum shaft is driven by the rotation means, a stopper is provided at a side of the other fulcrum shaft so that the ice making tray abuts against the stopper so as to twist the ice making tray in an axis direction thereof.

9. A vibrating device as claimed in claim 8, wherein, when an upper opening surface of the ice making tray faces a downward direction and the ice making tray abuts against the stopper so as to twist the ice making tray in the axis direction thereof.

* * * * *